United States Patent [19]

Hayashiguchi

[11] Patent Number: 4,638,844

[45] Date of Patent: Jan. 27, 1987

[54] WINDOW SCREEN

[76] Inventor: Seizo Hayashiguchi, 3454, Tsuoki, Sendo-cho, Tsu-shi, Mie, Japan

[21] Appl. No.: 767,510

[22] Filed: Aug. 20, 1985

[30] Foreign Application Priority Data

Feb. 1, 1985 [JP] Japan ..... 60-018978

[51] Int. Cl.[4] ..... E06B 9/08

[52] U.S. Cl. ..... 160/23 R

[58] Field of Search ..... 160/23 R, 26, 31

[56] References Cited

U.S. PATENT DOCUMENTS

| | | | |
|---|---|---|---|
| 1,266,716 | 5/1918 | Rolland | 160/23 R |
| 1,425,484 | 8/1922 | Jenkins | 160/23 R |
| 1,882,951 | 10/1932 | Rubrecht | 160/23 R |
| 2,543,118 | 2/1951 | Maffei | 160/23 R |
| 4,220,189 | 9/1980 | Marguez | 160/23 R |
| 4,398,585 | 8/1983 | Marlow | 160/23 R |
| 4,399,855 | 8/1983 | Volfson | 160/23 R |
| 4,458,739 | 7/1984 | Murray | 160/23 R |

*Primary Examiner*—Reinaldo P. Machado

*Attorney, Agent, or Firm*—Wenderoth, Lind & Ponack

[57] ABSTRACT

A window screen is proposed which comprises a frame, a casing, a roller mounted in the casing, a cover sheet wound around the roller and having strips attached to its opposite side edges and held in position by rails mounted in a pair of vertical stiles. The rails are loosely mounted and urged by cushioning members toward the stiles.

4 Claims, 6 Drawing Figures

WINDOW SCREEN

BACKGROUND OF THE INVENTION

The present invention relates to a window screen for preventing entry of mosquitos, or for closing openings such as a skylight, openings of a food service wagon used in hospitals or openings of boxes or coverings for protecting data processing devices such as computors.

Swinging doors, sliding doors or metal shutters are generally used to shut such openings of buildings or equipments. A swinging door requires a space large enough to accommodate the opened door, and a sliding door or metal shutter requires mounting operation on a large scale, thereby causing a higher cost.

SUMMARY OF THE INVENTION

An object of the present invention is to provide a window screen which obviates the abovesaid shortcomings.

In accordance with the present invention, there is provided a window screen comprising: a frame having a pair of vertical stiles; a casing provided at top of the frame; a roller rotatably mounted in the casing; a cover sheet wound around the roller with one end thereof secured thereto and having a bar secured to the other end thereof and having a fastener member attached to the side edges thereof over its entire length; and a rail provided in each of the stiles so as to extend vertically and formed with a groove to hold the fastener member therein.

Other objects and features of the present invention will become apparent from the following description taken with reference to the accompanying drawings, in which:

DETAILED DESCRIPTION OF THE PREFERRED EMBODIMENT

Figure 1:
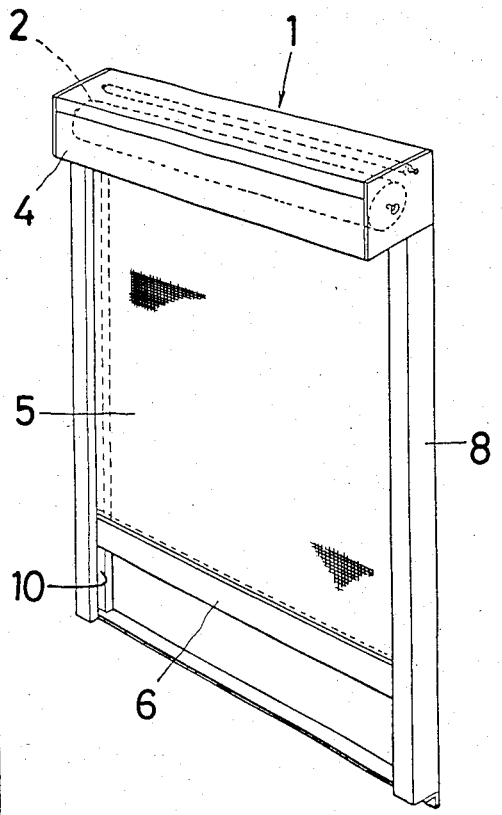
FIG. 1 is a perspective view of an embodiment having a net partially rolled up into the upper stile.
Figure 2:
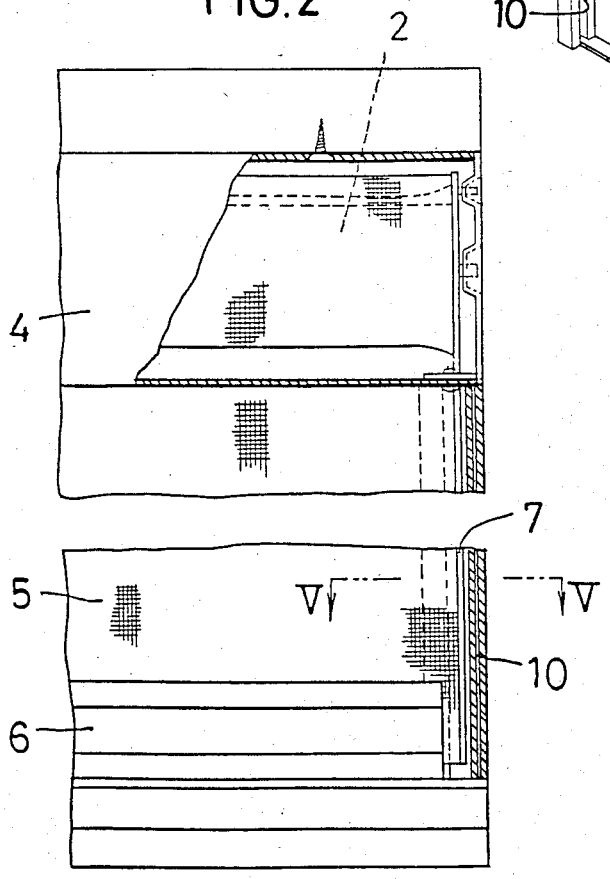
FIG. 2 is a partially cutaway enlarged front view of the same.
Figure 3:
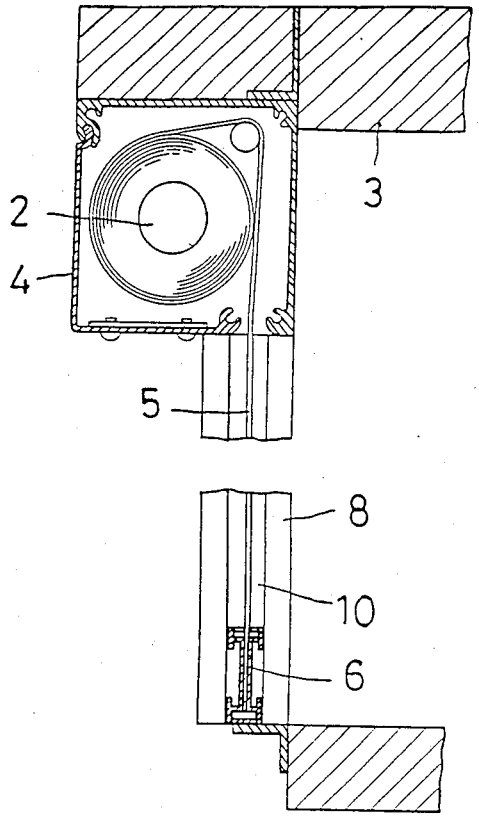
FIG. 3 is a vertical sectional side view of the same.

FIGS. 1 to 5 illustrate one embodiment of a window screen attached to an opening of a building. The numeral 1 designates a frame, and 2 designates a roller rotatably mounted within a box or casing 4 mounted on an upper stile 3. The roller has a coil spring mounted on its shaft to cause the roller to rotate in a take-up direction. But since this arrangement is known, the coil spring is not shown.

A sheet of net 5 is wound around the roller 2 with one end fixed thereto, and has a bar 6 secured to its lower end for use in pulling out of and retracting into the upper stile 3.

Figure 4:
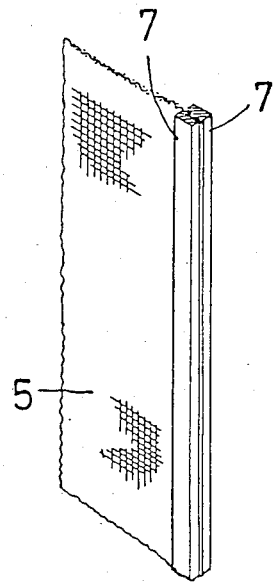
FIG. 4 is an enlarged perspective view of a part of the net.

As shown in FIG. 4, the net 5 is provided with fastener members 7 such as strips weldered or adhered to its opposite side edges over its entire length. The strip 7 may be manufactured by molding a soft or semi-rigid high polymer such as hot-melt synthetic resin or rubber.

Figure 5:
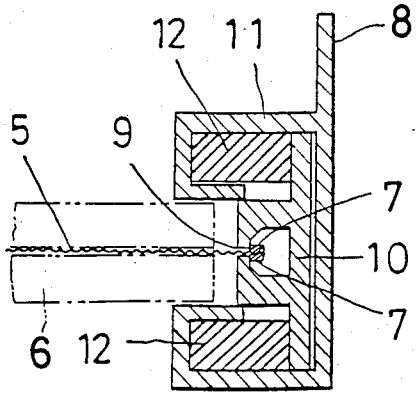
FIG. 5 is an enlarged sectional view taken along the line V—V of FIG. 2.

In each of the opposite inner sides of stiles 8 of the frame 1, as shown in FIG. 5, there is provided a rail 10 formed with a groove 9 adapted to prevent the strips 7 from slipping out.

In a food service wagon (not shown), the opening through which foods are taken out is provided in a cover sheet made from ventilative finely woven fabric and adapted to cover the food service wagon. The window screen of the present invention can be used to shut such an opening.

Data processors such as computors are usually accommodated in a non-ventilative box or casing for dust-tightness or thermal control. If the window screen is used with such a box, the sheet 5 must be made from a non-ventilative material.

In some cases, the window screen may be arranged so that the roller is mounted in one of the vertical stiles whereas the cover sheet wound around the roller can be pulled out in a horizontal direction.

Referring to FIG. 5, the rails 10 are loosely mounted within a bracket 11 molded integrally with the stiles 8 rather than being secured thereto with the main parts of the rails 10 exposed. Cushioning materials 12 made from e.g. sponge rubber are stuffed in the space between the molded bracket 11 and the rails 10 to push the rails 10 toward the stile 8, thereby to keep the net 5 tight. This will cause a suitable frictional resistance in the space between the rails 10 and the strips 7 so that the cover sheet 5 can be stopped even in a partly opened position.

The cushion materials may be in the form of a spring or a plastic molded spring having a fluff on its foot so that the frictional resistance will be maintained in the optimum condition.

With the abovesaid arrangement, the cover sheet such as a mosquito net is kept stretched tightly and elastically by provision of the cushioning members which urge the rail toward the stile.

Figure 6:
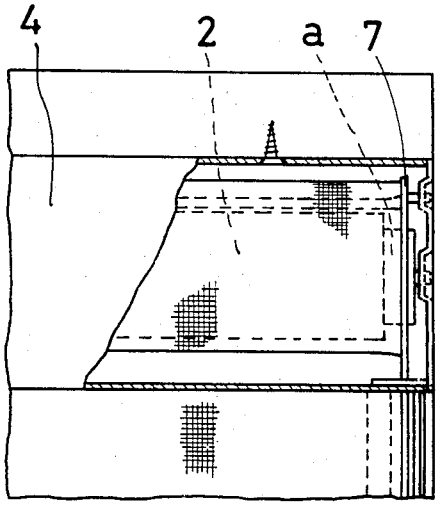
FIG. 6 is a partial vertical sectional side view of the second embodiment.

FIG. 6 shows another embodiment in which the roller 2 has a small-diameter portion a at each end thereof. The arrangement assures that the cover sheet with the strap at each end thereof can be wound around the roller 2 with uniform tightness.

What I claim:

1. A window screen comprising:

a frame having a pair of vertical stiles;

a casing provided at top of said frame;

a roller rotatably mounted in said casing;

a cover sheet wound around said roller with one end thereof secured thereto and having a bar secured to the other end thereof and having a fastener member attached to the side edges thereof over its entire length;

a rail provided in each of said stiles so as to extend vertically and formed with a groove to hold said fastener member therein; and a bracket integral with said stiles for holding said rail, and cushioning members mounted between said bracket and said rail so as to press said rail toward said stile, said rails being loosely held in said bracket.

2. The window screen as claimed in claim 1, wherein said fastener member is made of a soft high polymer.

3. The window screen as claimed in claim 1, wherein said cover sheet is a net.

4. The window screen as claimed in claim 1, wherein said cover sheet is non-ventilative.

* * * * *